US007134147B2

(12) United States Patent
Yount

(10) Patent No.: US 7,134,147 B2
(45) Date of Patent: Nov. 14, 2006

(54) PROTECTIVE EAR SHADES FOR CAPS

(76) Inventor: David E. Yount, 325 Yount Rd., Coushatta, LA (US) 71019-4109

( * ) Notice: Subject to any disclaimer, the term of this patent is extended or adjusted under 35 U.S.C. 154(b) by 0 days.

(21) Appl. No.: 11/214,288

(22) Filed: Aug. 29, 2005

(65) Prior Publication Data

US 2006/0053530 A1 Mar. 16, 2006

Related U.S. Application Data

(60) Provisional application No. 60/608,772, filed on Sep. 13, 2004.

(51) Int. Cl.
*A42B 1/06* (2006.01)

(52) U.S. Cl. ..... 2/209; 2/209.13; 2/195.1

(58) Field of Classification Search ..... 2/174, 2/209, 209.13, 423, 172; D2/866, 872, 882
See application file for complete search history.

(56) References Cited

U.S. PATENT DOCUMENTS

| | | | | |
|---|---|---|---|---|
| 280,005 | A | 6/1883 | Beard et al. | |
| 1,805,734 | A * | 5/1931 | Jones | 2/465 |
| 2,156,251 | A * | 4/1939 | Carlson | 2/175.1 |
| 2,442,825 | A * | 6/1948 | Rabushka | 2/195.5 |
| 2,676,325 | A | 4/1954 | Carlson | 2/172 |
| 4,633,530 | A | 1/1987 | Satterfield | 2/423 |
| 4,864,662 | A * | 9/1989 | Frank | 2/183 |
| 5,119,514 | A * | 6/1992 | Woehl | 2/172 |
| 5,121,507 | A | 6/1992 | Brown | 2/199 |
| 5,125,113 | A | 6/1992 | Yun | 2/10 |
| 5,153,943 | A | 10/1992 | Clement | 2/199 |
| D340,796 | S * | 11/1993 | Oates | D2/882 |
| 5,426,790 | A * | 6/1995 | Robertson | 2/209.13 |
| 5,493,733 | A | 2/1996 | Fospisil | 2/195.1 |
| 5,675,840 | A * | 10/1997 | Clavelle | 2/174 |
| 6,079,052 | A | 6/2000 | Veridiano | 2/172 |
| 6,550,064 | B1 | 4/2003 | Schmitt et al. | 2/10 |

* cited by examiner

*Primary Examiner*—Gary L. Welch
*Assistant Examiner*—Richale L. Haney
(74) *Attorney, Agent, or Firm*—John M. Harrison

(57) ABSTRACT

Protective ear shades for headwear such as caps, which shades include a pair of cupped or oblate shades extending from stitched or sewn attachment to the sides of the cap over the ears to protect the ears from ultraviolet radiation. In a preferred embodiment the protective ear shades curve from the headband or side margin of the cap upwardly and outwardly in a cupped configuration toward the crown and then downwardly and forwardly to the bill of the cap. In another preferred embodiment of the invention one or more stiffeners or reinforcements are provided in the ear shades to maintain the shades in the desired protruding, cupped and oblate configuration over the ears.

3 Claims, 1 Drawing Sheet

PROTECTIVE EAR SHADES FOR CAPS

CROSS-REFERENCE TO RELATED APPLICATIONS

This application claims the benefit of and incorporates by reference prior filed copending U.S. Provisional Patent Application, Ser. No. 60/608,772, Filed Sep. 13, 2004.

SUMMARY OF THE INVENTION

This invention relates to protective covers or shades provided on headwear such as caps and hats for protecting at least the tops of the ears of the wearer from the damaging effects of ultraviolet radiation. More particularly, the invention is characterized by protective ear shades that extend upwardly and outwardly in a cupped configuration from both sides of a cap at the headband or side margin to shade at least the tops of the ears and shade the ears from the ultraviolet radiation. In a preferred embodiment the protective ear shades extend from the headband or side margin of the cap upwardly and outwardly toward the crown of the cap and then forwardly, downwardly and outwardly to the bill of the cap. In a most preferred embodiment of the invention the protective ear shades are sewn or stitched to the cap and each includes one or more reinforcing member(s) therein for maintaining a preferred curved and cupped or oblate shape of the shades.

BRIEF DESCRIPTION OF THE DRAWING

The invention will be better understood by reference to the accompanying drawing, wherein.

DESCRIPTION OF THE PREFERRED EMBODIMENTS

Figure 1:
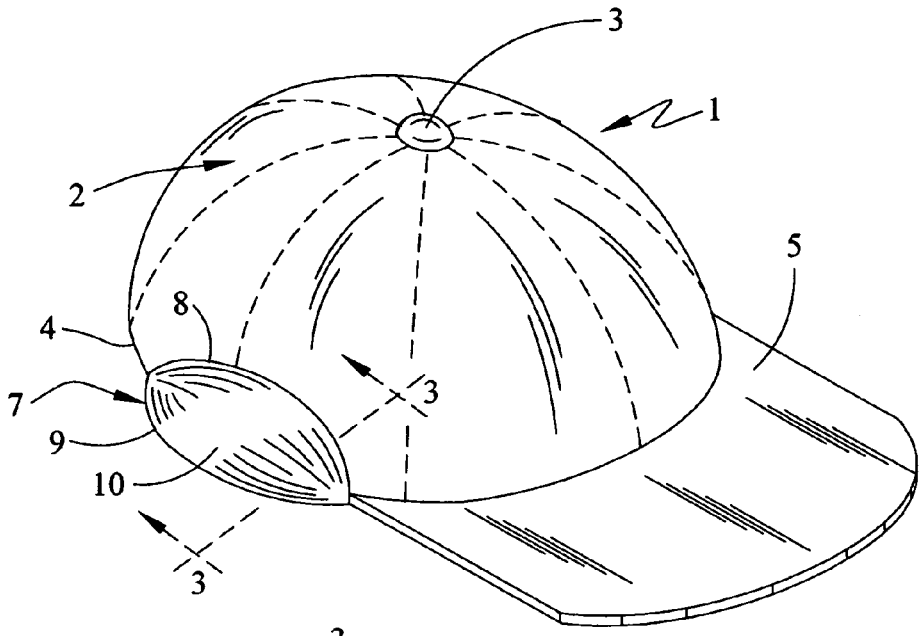
FIG. 1 is a perspective view of a preferred embodiment of the protective ear shades of this invention, stitched or sewn to a cap having a bill.
Figure 2:
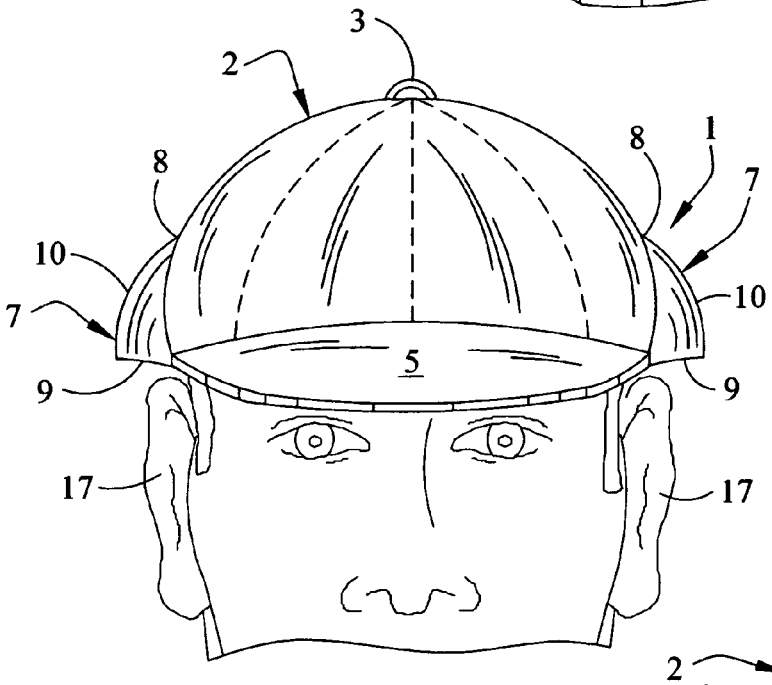
FIG. 2 is a front elevation of the protective ear shades and cap illustrated in FIG. 1.
Figure 3:
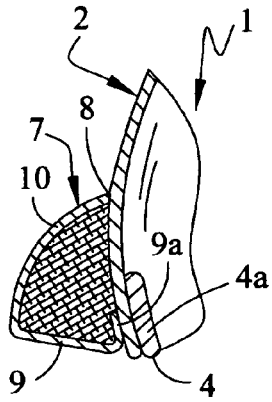
FIG. 3 is a sectional view taken along line 3—3 of one of the protective ear shades illustrated in FIG. 1.

Referring initially to FIGS. 1–3 of the drawings, the protective ear shades of this invention are generally illustrated by reference numeral 7 and are typically glued, stitched or sewn on both sides of a cap 1 having a cap crown 2 that typically extends to a crown button 3 at the top of the cap 1. The ear shades 7 typically terminate along the bottom of a headband edge 4 of a headband 4*a* on each side of the cap 1 and extend forwardly a selected distance to a bill 5. Each of the ear shades 7 is characterized by a curved top shade stitching 8 that secures the rounded top edge of the respective ear shade 7 to the cap 1 toward the cap crown 2. The top shade stitching 8 also extends rearwardly of the bill 5 to the headband edge 4 of the headband 4*a* and projects forwardly along a curved bottom shade margin 9 back to the bill 5, as further illustrated in FIG. 1 of the drawings. The cupped oblate side panel 10 of each of the ear shades 7 is therefore defined by the top shade stitching 8 and the stitching along the bottom shade margin 9 and is generally of sufficient size to adequately shield, cover or shade at least the top portion of the ears 17 of a user, as further illustrated in FIG. 2 of the drawings. Accordingly, it will be appreciated by those skilled in the art that the size of the ear shades 7 can be selected such that the oblate side panels 10 are sufficiently large to shade at least the top portions of the ears 17, regardless of the shape and design of the cap 1 or the size of the ears 17.

Referring now to FIG. 3 of the drawings in another preferred embodiment of the invention the top shade stitching 8 serves to secure the curved top edge of each of the ear shades 7 to the cap 1 facing the cap crown 2. A margin tab 9*a*, provided in the bottom of each end of the ear shades 7 at the bottom shade margin 9, is configured to rest against the hat crown 2 at the headband edge 4 of the headband 4*a* of the cap 1 and is typically stitched in place in that position. Accordingly, that space between the margin tabs 9*a* at each end of the ear shades 7, respectively, is typically open to accommodate the tops of the ears 17 when the cap 1 is pulled tightly down over the head of a wearer.

Figure 4:
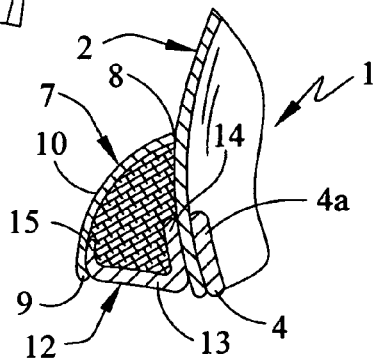
FIG. 4 is a sectional view taken along line 3—3 of the ear shades illustrated in FIG. 1, more particularly illustrating one of two spaced-apart shade stiffeners or reinforcing members provided in the ear shades to maintain the shades in a cupped and oblate extended configuration over the tops of the ears of a user.

In an alternative preferred embodiment of the invention and referring again to FIG. 4 of the drawings, a shade stiffener 12 is fitted inside each end of the respective ear shades 7 adjacent to or in place of the margin tabs 9*a* and is typically stitched or may be bonded to the side panels 10 of each of the ear shades 7 at an outer tab 15. Each shade stiffener 12 is typically stitched or bonded to the cap crown 2 of the cap 1 at the headband 4*a* by means of a corresponding inner tab 14, as further illustrated in FIG. 4. Accordingly, it will be appreciated by those skilled in the art that the stiffener base 13 of each of the shade stiffeners 12 serves to improve the structural integrity of the side panel 10 of the ear shade 7 and maintain the side panel 10 outwardly of the headband edge 4 of the cap 1 in an oblate configuration, to maintain each of the ear shades 7 securely over the top of the respective ears 17 of the user.

It will be further appreciated by those skilled in that art that the ear shades 7 of this invention are designed to shade and therefore protect at least the upper portion of the ears 17, illustrated in FIG. 2 of the drawing, from sunburn due to ultraviolet radiation exposure. Accordingly, the size of the ear shades 7 may be varied as the top shade stitching 8 is extended upwardly in a desired curvature toward the cap crown 2, thereby making the side panels 10 of sufficient size to accomplish the purpose. Furthermore, in another preferred embodiment of the invention the bottom shade margin 9 of each of the side panels 10 of the ear shades 7 is aligned with the headband edge 4 of the cap 1.

While the preferred embodiments of the invention have been described above, it will be recognized and understood that various modifications may be made in the invention and the appended claims are intended to cover all such modifications which may fall within the spirit and scope of the invention.

What is claimed is:

1. Ear shades for a cap having a headband, the cap extending upwardly from the headband to define a crown and the headband extending forwardly to a bill, said ear shades comprising a pair of cupped shades stitched to opposite sides of the cap, above the headband, said cupped shades extending forwardly along the cap to said bill, and bottom shade margins defining a bottom edge extending inwardly from outer side margins of said cupped shades, said bottom edge of said cupped shades substantially aligned with the bottom edge of the headband of the cap, respectively, for shading and protecting at least the tops of the ears of a wearer from the effects of ultraviolet radiation.

2. The ear shades of claim 1 wherein said shades extend upwardly from said bill and said side margins along a curved top ear shade margin toward said crown of said cap.

3. Ear shades for mounting on the side margins of a cap having a crown and a bill terminating at the side margins, said ear shades comprising a pair of oblate shades stitched to opposite sides of the cap at the side margins, said oblate shades also extending forwardly along the side margins and substantially even with the side margins to said bill and rearwardly of said bill a selected distance, said oblate shades also extending inwardly to the side margins on opposite sides of the cap, respectively, and stiffeners provided between the oblate shades and the side margins on opposite sides of the cap, respectively, for shading and protecting at least the tops of the ears of the wearer from the effects of ultraviolet radiation.

* * * * *